US005683124A

United States Patent [19]

Karpisek

[11] Patent Number: 5,683,124

[45] Date of Patent: Nov. 4, 1997

[54] LATCHING DEVICE FOR A HINGED PANEL

[76] Inventor: Ladislav Stephan Karpisek, 86 Woodfield Boulevarde, Caringbah, New South Wales 2229, Australia

[21] Appl. No.: 627,664

[22] Filed: Apr. 1, 1996

[30] Foreign Application Priority Data

Apr. 3, 1995 [AU] Australia ..... PN2077

[51] Int. Cl.[6] ..... E05C 1/06

[52] U.S. Cl. ..... 292/143; 292/140; 292/336.3; 292/DIG. 20; 292/DIG. 33; 292/DIG. 35; 292/DIG. 47

[58] Field of Search ..... 292/143, DIG. 20, 292/DIG. 33, DIG. 35, DIG. 47, 140, 336.3

[56] References Cited

U.S. PATENT DOCUMENTS

| | | | |
|---|---|---|---|
| 918,327 | 4/1909 | Jordan | 292/DIG. 20 |
| 1,664,602 | 4/1928 | Everett | 292/140 |
| 3,949,525 | 4/1976 | Bates et al. | 292/140 |
| 4,083,808 | 4/1978 | Greisner | 292/DIG. 20 |
| 4,991,886 | 2/1991 | Nolte et al. | 292/DIG. 33 |
| 5,087,087 | 2/1992 | Vetter et al. | 292/DIG. 47 |
| 5,089,139 | 2/1992 | Larsson | 292/337 |
| 5,143,412 | 9/1992 | Lindqvist | 292/DIG. 47 |
| 5,219,195 | 6/1993 | Lawrence | 292/DIG. 33 |

FOREIGN PATENT DOCUMENTS

| | | |
|---|---|---|
| 1071532 | 4/1956 | Germany . |
| 2266336 | 10/1993 | United Kingdom . |

*Primary Examiner*—Steven N. Meyers
*Assistant Examiner*—Stephen J. Pentlicki
*Attorney, Agent, or Firm*—Edwin D. Schindler

[57] ABSTRACT

A latching device (5) including a housing (7) with a latching member (15) connected through track followers (16,17) to a track (10,11,12,13,14) in the housing (7). A lever (6) pivotally connected to the housing (7) has a track follower (20) engaged in a track (21) in the latching member (15). A lug (18) on the latching member (15) is disposed adjacent an opening in the housing (7) dimensioned to receive a latch lug (4). Pivotal movement of lever (6) causes movement of follower (2) in the track (21) with resultant planar movement of the latching member (15) as the track followers (16,17) traverse the track (10,11,12,13,14) the shape of which also produces movement of the lug (18) between extended and retracted positions relative to said housing opening.

6 Claims, 3 Drawing Sheets

LATCHING DEVICE FOR A HINGED PANEL

FIELD OF THE INVENTION

This invention relates to latches for hinged panels such as doors and windows, It has been primarily devised to hold a hinged glazed window panel of the casement type closed in a secure manner.

BACKGROUND OF THE INVENTION

Casement windows of a first known form include a glazed panel which is pivotally opened and closed manually and retained open to a desired degree by a suitable strut. In a second known form the glazed panel is connected to a winding mechanism whereby the glazed panel is pivotally opened and closed with the winding mechanism also serving as a means to maintain a desired degree of window panel opening.

In both of the above forms it is common to provide a latching arrangement whereby the glazed panel can be latched tightly closed in sealed engagement with a window frame.

There are several latching arrangements currently available and in each there is a moving element mounted in a housing on the glazed panel for engagement with a fixed element mounted on the window frame.

In a latching sequence the glazed panel is positioned to provide initial alignment of the moving element with the fixed element without movement of the moving element. A lever connected to the moving element is then moved through a first stage to cause co-operating parts of the first and second elements to interact to pull the glazed panel hard against the window frame. This is followed by movement of the lever through a second stage resulting in the moving element then being "secured" against unauthorised forced movement as may be attempted, for example, by a burglar working from outside the window.

The latching arrangements as discussed above have operational disadvantages. In one latching arrangement the moving element is operated by a lever which moves arcuately relative to the plane of the glazed panel. This can interfere with some forms of window furnishings, such as blinds and curtains, which are wide enough to extend over the window frame. This problem is not present in another known latching arrangement because the operating lever for the moving element moves arcuately in a plane parallel to the plane of the glazed panel.

However, with the latter form of latching arrangement right and left hand latches are required to cater for right and left hand opening windows. In addition, in this form of latching arrangement the means for securement of the moving element has not been able to provide long term efficient operation. This is primarily due to reliance on resilient deflection of a securing element as the lever is moved through the second operating stage. Fatigue and wear of the securing element are not unknown.

SUMMARY OF THE INVENTION

The latching arrangement of the present invention is made in a form which can be used for right and left hand opening windows, the lever for operation of the moving element does not interfere with window furnishings and the securement means for the moving element is positive and not prone to the problems associated with the known latches.

Broadly stated the invention can be said to provide a latching device for engagement with a latch lug to releasably secure a hinged panel in a closed condition. The latching device includes a housing with continuous first track means having two identical arcuate sections providing two track peaks. A linear, intermediate section of the track means connects adjacent ends of the arcuate sections and linear end sections of the track means at the distal ends of the arcuate sections. A movable latching member in the housing is included, having a pair of track followers spaced apart so as to lie in corresponding parts of the first track means as the latching member moves relative to the first track means. Second track means on the latching member is provided, and a lever is pivotally connected intermediate its ends to said housing, with second track follower means on said lever. Engagement means on the latching member is disposed adjacent an opening in said housing dimensioned to receive a panel mounted latch lug for engagement by said engagement means. Pivotal movement of the lever relative to said housing causes movement of the second track follower means along the second track means and movement of said pair of track followers along said first track means to produce planar movement of said latching member and movement of said engagement means between an extended position, wherein said pair of track followers are at the peaks of the first track means and a retracted position where the track followers, of said pair of track followers, respectively lie in the intermediate section and one of the end sections of said first track means.

GENERAL DESCRIPTION OF THE DRAWINGS

Preferred embodiments of the invention will now be described with reference to the accompanying drawings in which:

FIG. 1 is a fragmentary perspective view illustrating the latching device of the invention in working relationship with a panel mounted latch lug, FIG. 2 is a diagrammatic elevational view showing the latching member of the latching device in its retracted and secured condition, FIG. 3 is a view similar to FIG. 2 wherein the latching member is in the retracted but unsecured condition as a first part of the operation of the latching device to move the engagement means of a latching member towards engagement with a panel mounted latch lug, FIG. 4 is a view similar to FIG. 3 showing the latching member as it would be just prior to being moved towards its extended condition and into operational juxtaposition with the latch lug, FIG. 5 shows the latching device advanced towards its extended condition with the engagement means of the latching member moving into engagement with the latch lug, FIG. 6 is a view similar to FIG. 5 with the engagement means engaged with the latch lug, FIG. 7 is a view similar to FIG. 6 with the latching member being moved towards its retracted condition and exerting a force on the latch lug to draw the panel to the closed condition, FIG. 8 is a view similar to FIG. 7 with the latching member in the retracted but unsecured condition, FIG. 9 shows the latching member fully retracted and secured and FIG. 10 is an enlarged illustration of the shape of a track means providing securement against unauthorised movement of the lever which operates the latching device.

DETAILED DESCRIPTION OF THE DRAWINGS

Figure 1:
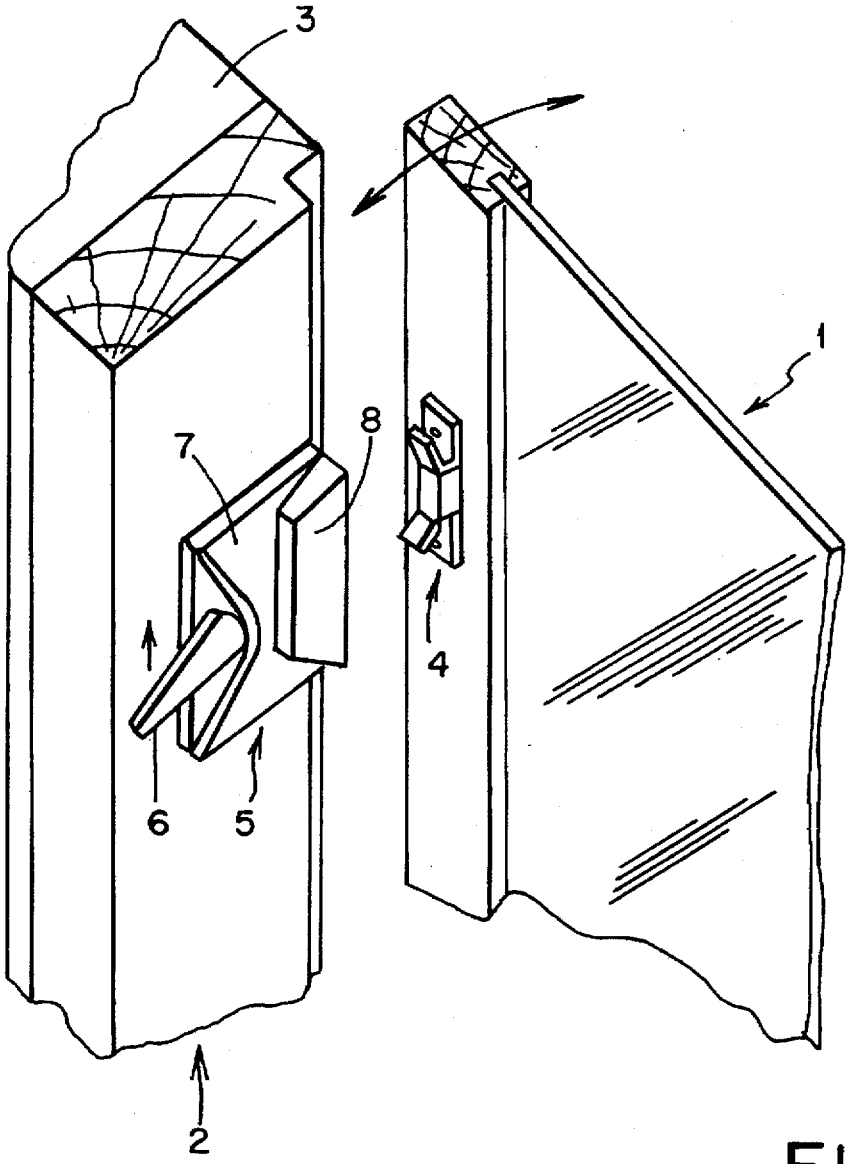

FIG. 1 shows a partly opened hinged glazed panel 1 in juxtaposed relationship to a window frame 2 in a wall 3.

A latching element 4 including a latch lug is mounted on the panel 1 and the latching device of the invention is indicated 5 and is mounted on the window frame 2.

The device 5 includes a housing 7 to which is mounted a pivotally movable lever 6, The housing 7 includes a raised portion 8 in which is housed a movable latching member.

Figure 2:
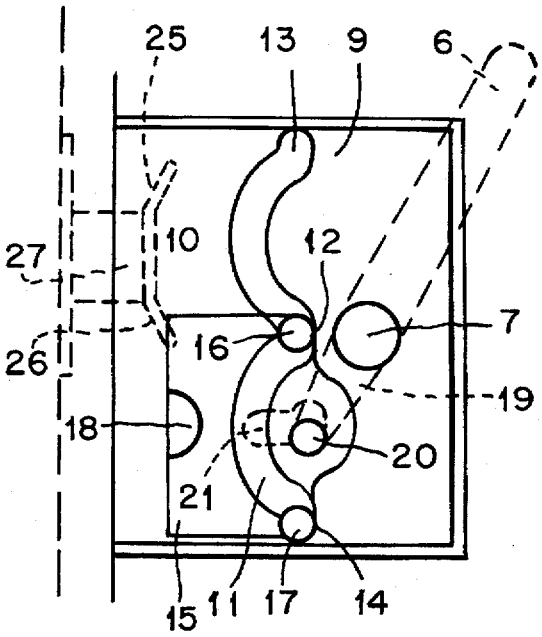

The operation of the latching device will now be described with reference to FIGS. 2 to 9. In FIG. 2 there is shown a track plate 9 which is mounted in the housing below the raised housing portion 8. The plate 9 is provided with a profiled track for track followers. The track is comprised of two like curved sections 10 and 11 defining peaks disposed between troughs. The troughs at the adjacent ends of the sections 10 and 11 form a single common trough 12 and troughs at the distal ends of the sections 10 and 11 are numbered 13 and 14. Although the track in the illustrated example is a continuous slot in the plate 9 it is to be understood that the troughs at the adjacent ends of the sections 10 and 11 need not be joined to form a single trough 12.

The movable latching member of device is indicated 15. It is disposed between the plate 9 and the underface of the housing portion 8 and is spaced from the underface of the housing portion 8. The member 15 has spaced track followers 16 and 17 in the form of pegs which are engaged in the track and it is provided with an engagement means in the form of a lug 18 which upstands from the plane of the member 15.

Figure 10:
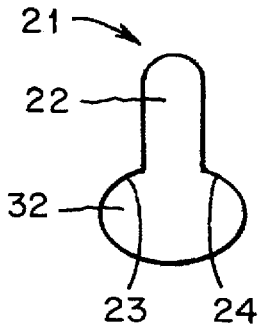

The lever 6 includes a portion 19 which lies within the housing and is has a pin 20 engaged in a track means 21 in the member 15. The track means 21 is best seen in FIG. 10 and includes a working portion in the form of a slot 22 with parallel sides, which is closed at one end and which terminates at its other end in an enlarged portion 32. The portion 32 includes faces 23 and 24 which respectively extend away from edges of the slot 22 of the track means 21. The faces 23,24 provide securement for the lever and the coupled latching member and prevent release of the latching device by means of external forces applied directly to the latching member. The faces 23 and 24 are preferably curved and both have the same radius centered on the axis 7 about which the lever 6 pivots.

The latching element 4 has upper and lower latch lugs 25 and 26 either side of and angled with respect to a central portion 27.

Figure 3:
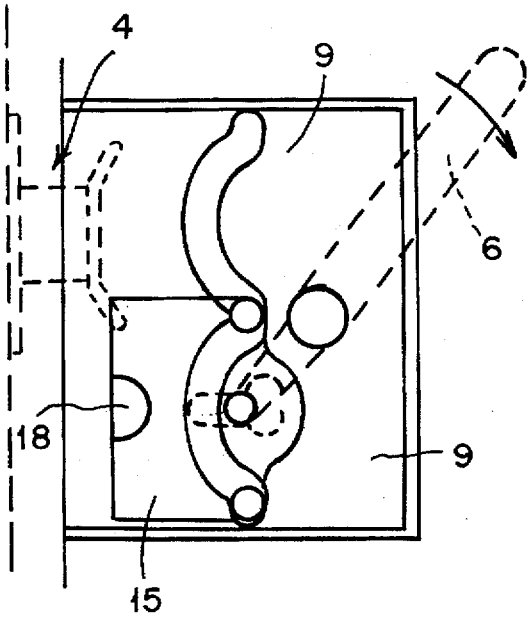

In an operating sequence, the glazed panel 1 is brought into proximity with the window frame, to the extent that the latching element 4 enters into an opening in the housing to locate the latch lug 26 in adjacent relationship to the lug 18 of the latching member 15. This is the FIG. 2 condition. In FIG. 3 the lever 6 has been pivoted downwardly and the lever pin 20 will leave the lever securing face 23 and enter the open end of the slot 22.

Figure 4:
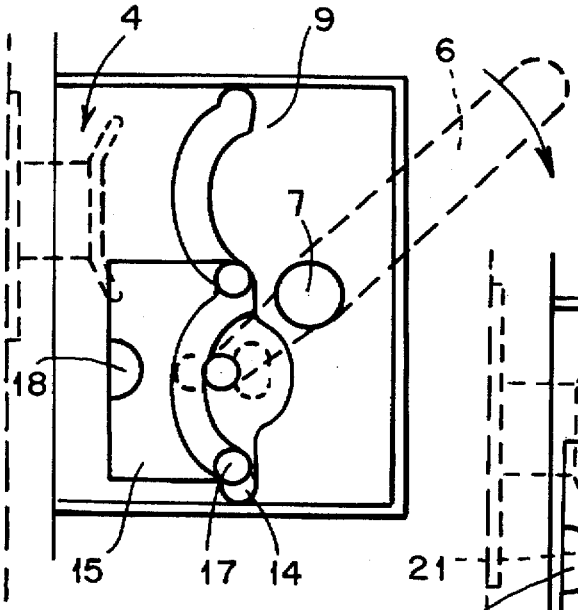

In FIG. 4 the lever 6 has been pivoted further and side pressure will be exerted by the pin 20 against the side of the slot 22. This causes the latching member 15 to move laterally in the plane of the member 15 and the track following pegs 16,17 to enter the curved track sections 10,11.

Figure 5:
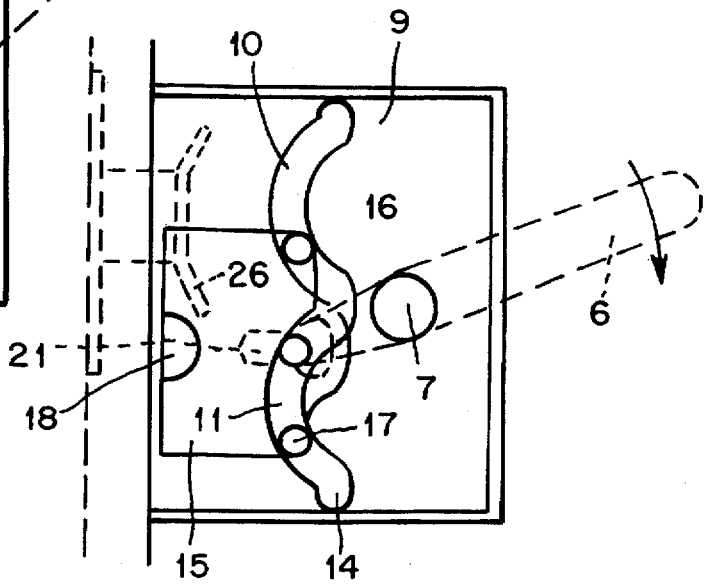

In FIG. 5 the pivotal movement of the lever 6 has advanced the latching member 15 to place the pegs 16 and 17 in the curved track portions 10 and 11 and the latching member lug 18 in operational relationship with the rear face of the latch lug 26 of the latching element 4.

Figure 6:
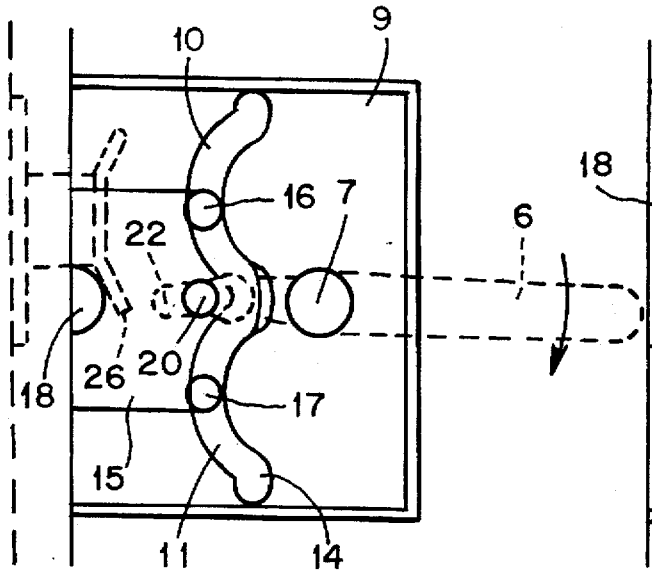

In FIG. 6 further movement of the lever 6 has entered the pin 20 into the slot 22 and has brought the lug 18 into pressure contact with the latch lug 26.

Figure 7:
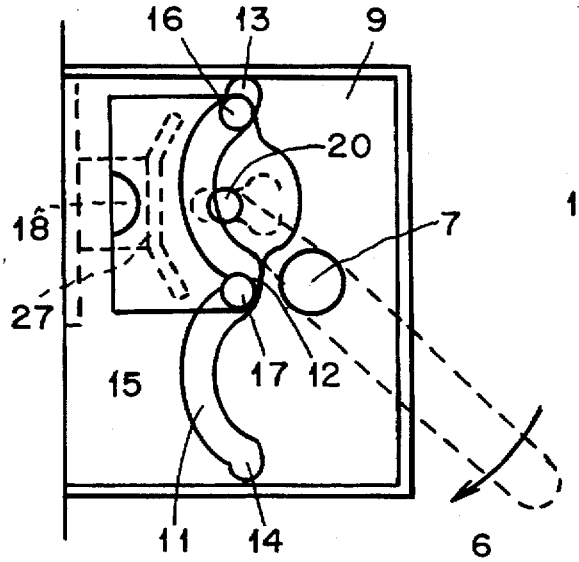

In FIG. 7 further movement of the lever 6 has forced the lug 18 onto the central portion 27 of the latching element 4 to move the glazed panel first towards and then into engagement with the window frame. In this condition the pegs 16 and 17 have substantially traversed the curved portions 10 and 11 of the track and are at the entrances to the track trough portions 13 and 12 respectively, with the lever pin 20 about to exit the track slot portion 22.

Figure 8:
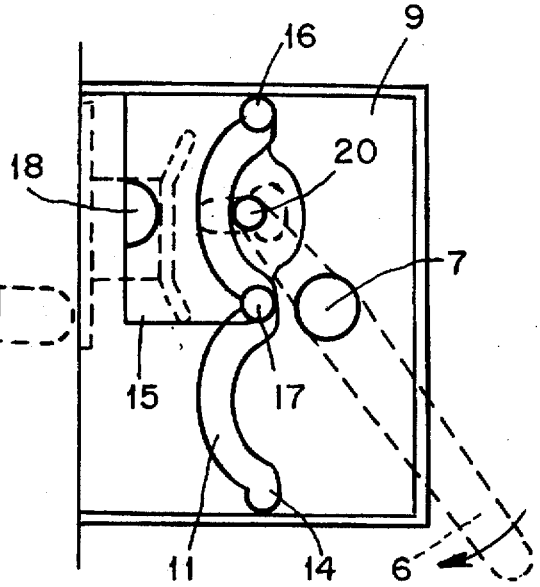

In FIG. 8 the lever 6 has moved to the extent that the pins 17 and 16 are resident in the track troughs 12 and 13. It is to be noted that the lever pin 20 is positioned at the junction of the curved face 24 with the slot 22.

Figure 9:
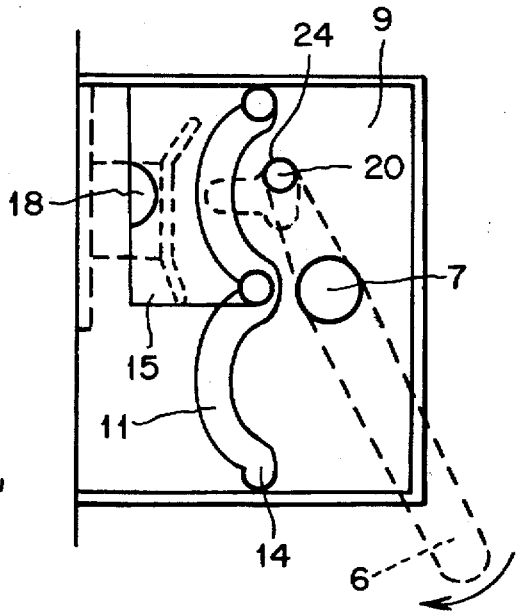

FIG. 9 shows the final positioning of the lever 6. Pivotal movement beyond the FIG. 8 position has caused the pin 20 to progress onto and along the curved face 24, with no further movement of the latching member 15. This is the "secured" condition for the lever 6.

As will be seen from FIG. 9, forces applied from outside the window to the latching member 15 in a downward manner to try to achieve the unlatching of the lug 18 from the latching element 4 will only cause the curved face 24 to bear more firmly against the pin 20 without promoting any pivotal unlatching movement of the lever 6.

Unlatching movement can however be readily achieved by movement of the lever 6 in a manner reverse to that described above.

As will be clear from the foregoing by inverting the housing the latching device will function in the same manner for a window which opens in the direction opposite to that contemplated by the foregoing description, In that arrangement the lug 18 would co-act with the latch lug 25 and 27 of the latching element 4.

It is envisaged that there could be remote second latching device, as on a large window, with the two housings positioned adjacent the top and bottom of the glazed panel. The second latching device need not be a "secured" latch but could be a slave or follower latch. By increasing the length of the lever arm in the slave latching device between the pivot axis 7 of the lever 6 the pin 20 the pin would not be engagable in the "securing" portion of the opening 21 of the latching member 15. To accommodate the extra length the slot 22 would be made longer at its closed end than is required to accommodate the lug 20 of a latch adapted to be "secured". In this way a latch can have a "securable" configuration or a slave configuration simply by replacing the lever 6. To allow this the lever 6 is readily removable from the latch housing.

Whilst the track as illustrated is arcuate it is to be understood that other shapes of track are possible. For example, a track with two angled straight sections between the portions 12,13 and 12, 14. The requirements for the track are that there is a peak in each track portion between the end zones of the track and that the two track portions are of the same form.

The foregoing is a description of a preferred embodiment of the invention and it is to be understood that changes can be made to the various specific constructions described and illustrated without departing from the inventive concept herein disclosed.

I claim:

1. A latching device for engagement with a latch lug for releasably securing a hinged panel in a closed condition, said latching device comprising:

a housing with a continuous first track having two identical arcuate sections providing two track peaks, a linear intermediate section of said track connecting adjacent ends of the arcuate sections and linear end sections of said track at distal ends of said arcuate sections;

a movable latching member in said housing having a pair of track followers spaced apart and lying in corresponding parts of said first track as said latching member moves relative to said first track;

second track on said latching member;

a lever pivotally connected intermediate at its ends to said housing;

second track follower on said lever;

engagement means on said latching member disposed adjacent an opening in said housing dimensioned for receiving a panel mounted latch lug for engagement by said engagement means, wherein pivotal movement of said lever relative to said housing causes movement of said second track follower along said second track and movement of said pair of track followers along said first track for producing planar movement of said latching member and movement of said engagement means between an extended position, in which said pair of track followers are at the peaks of said first track, and a retracted position, in which said track followers of said pair of track followers respectively lie in the intermediate section and one of the end sections of said first track.

2. The latching device according to claim 1, wherein said engagement means moves arcuately as said latching member is moved by said lever.

3. The latching device according to claim 1, wherein said second track is a slot having a working portion defined by parallel edges of said slot and a lever securement portion and said second track follower being a pin fixed to said lever, said pin traversing said slot working portion as the arcuate sections of said first track are traversed by said pair of track followers and enters said lever securement portion when the track followers of said pair of track followers enters the intermediate and an end section of said first track.

4. The latching device according to claim 3, wherein said lever securement portion of said second track includes two curved faces respectively extending in opposite directions away from said parallel edges of said slot, the curvatures of said faces having a same radius with an axis of the pivot of said lever as centered.

5. The latching device according to claim 4, wherein said lever securement portion of said second track is an opening through said latching member with an opening defining wall comprised of said curved faces and a back face, said back face and said curved faces defining two notches located on adjacent each of said parallel edges of slot for receiving said pin fixed to said lever.

6. The latching device according to claim 1, wherein said engagement means is a lug on said latching member, upstanding from said latching member and a plane in which said latching member is moved by said lever.

* * * * *